US005123273A

United States Patent [19]

Kawabata

[11] Patent Number: 5,123,273

[45] Date of Patent: Jun. 23, 1992

[54] HOG RING CLAMPING DEVICE

[75] Inventor: Yosoo Kawabata, Kamisato, Japan

[73] Assignee: Meiho Co., Ltd., Kanagawa, Japan

[21] Appl. No.: 700,566

[22] Filed: May 15, 1991

[30] Foreign Application Priority Data

Nov. 26, 1990 [JP] Japan ..... 2-321901

[51] Int. Cl.[5] ..... B21D 7/06

[52] U.S. Cl. ..... 72/409; 72/424; 29/243.56; 29/816; 226/148; 226/160; 226/167; 221/312 A

[58] Field of Search ..... 72/410, 409, 424, 453.16; 29/253.56, 816, 818, 811.2; 221/312 A, 277; 227/120, 125, 136, 135; 226/148, 160, 167

[56] References Cited

U.S. PATENT DOCUMENTS 2,350,192 5/1944 Redman ..... 221/277
3,628,230 12/1971 Grise ..... 29/243.56
3,854,648 12/1974 Inzou ..... 227/136
3,863,823 2/1975 Allred ..... 226/148
4,546,528 10/1985 Langas ..... 29/243.56

*Primary Examiner*—Daniel C. Crane
*Attorney, Agent, or Firm*—Peter L. Michaelson

[57] ABSTRACT

The present invention relates to a hog ring clamping device such as a C ring clamping device. In the hog ring clamping device of the invention, a knock pin is mounted to a movable member of a jaw driving unit, a pivotable member is mounted to a hog ring clamping device body, the pivotable member is pushed against the knock pin by means of spring, a feed member is mounted to the pivotable member so that it can come into contact with hog rings engaged with a magazine, and a presser wheel is mounted to the hog ring clamping device body through a unidirectional rotating unit so as to be in contact with the hog rings engaged with the magazine.

3 Claims, 3 Drawing Sheets

HOG RING CLAMPING DEVICE

BACKGROUND OF THE INVENTION

1. Field of the Invention

The present invention relates to a hog ring clamping device such as a C ring clamping device.

2. Description of the Prior Art

In a conventional C ring clamping device, a magazine is mounted near a clamping portion of the clamping device body, and one end of a spiral spring is attached to the clamping device body, while the other end of the sprial spring is attached to a C ring feed member having a hole.

A large number of C rings are arranged in a row and an adhesive tape is bonded to the backs of the C rings to form a C ring assembly comprising a large number of such C rings. In the conventional C ring clamping device, by moving a C ring feed member against the spiral spring it is removed from the magazine, and in this state the C ring assembly is loaded onto the magazine. Then, the magazine is inserted into the hole of the C ring feed member. In this state, the force of the spiral spring is exerted on the C ring assembly through the C ring feed member, so that the C ring assembly is fed to the clamping portion.

In such conventional C ring clamping device, however, since it is impossible to make the C ring assembly longer than the magazine, the number of C rings capable of being loaded at a time is limited and hence the C ring assembly loading operation must be done more frequently, resulting in that the C ring clamping operation becomes troublesome.

SUMMARY OF THE INVENTION

It is an object of the present invention to provide a hog ring clamping device capable of greatly improving the efficiency of the hog ring clamping operation.

According to the present invention, there is provided a hog ring clamping device comprising a hog ring clamping device body, jaws provided in said hog ring clamping device body, a driving means for moving said jaws pivotally, a hog ring magazine mounted to said hog ring clamping device body, a knock pin mounted to a movable member of said driving means, a pivotable member mounted pivotably to said hog ring clamping device body and capable of coming into contact with said knock pin, a spring for urging said pivotable member against said knock pin, a feed member mounted to said pivotable member in a position for contact with the hog rings engaged with said magazine, and a presser wheel mounted to said hog ring clamping device body through a unidirectional rotating means in a position for contact with the hog rings engaged with said magazine.

In the hog ring clamping device of the invention, when the driving unit is operated, the knock pin moves, so that the pivotable member moves pivotally and hence hog rings are fed by the feed member. Further, since the backward movement of the hog rings is prevented by the presser wheel, the hog ring assembly can be fed by pushing the forefront portion thereof. Consequently, the hog ring assembly can be made very long, so the hog ring assembly loading operation can be greatly simplified and hence the efficiency of the hog ring clamping operation can be improved to a great extent.

DETAILED DESCRIPTION OF THE INVENTION

Figure 1:
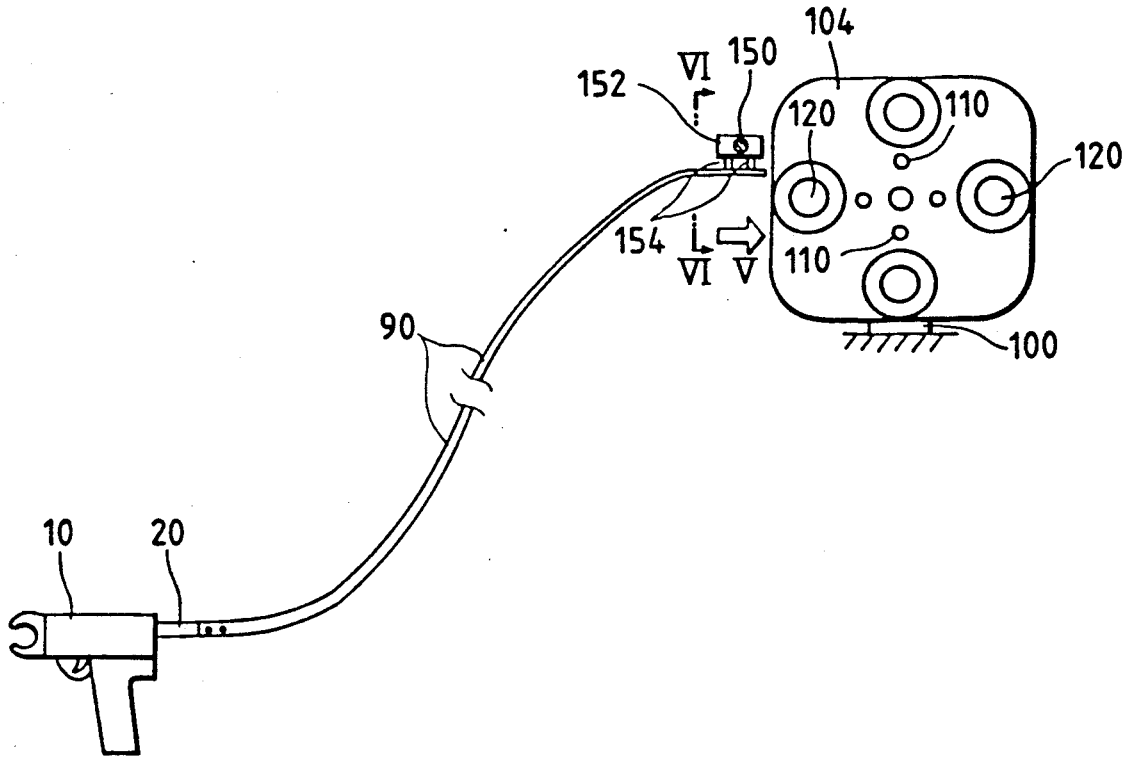
FIG. 1 is a schematic front view showing a C ring clamping device according to the present invention and a C ring feeding device for feeding C rings to the C ring clamping device.
Figure 2:
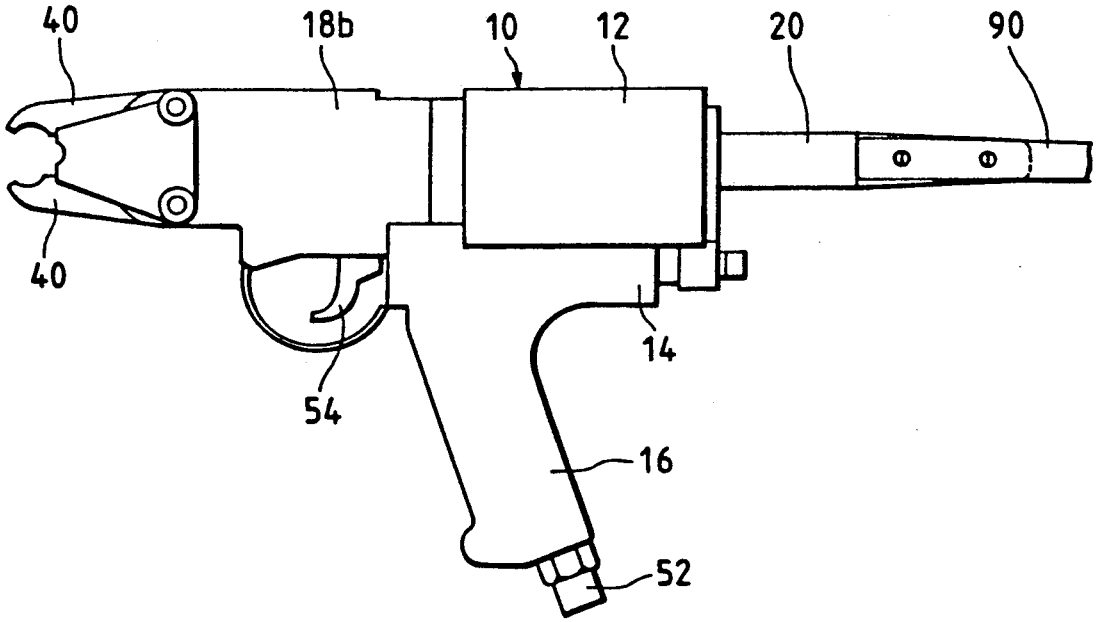
FIG. 2 is a front view of the C ring clamping device.

As shown in FIG. 2, a C ring clamping device body 10 has a cylinder housing 12 which houses an air cylinder (not shown) therein, a valve housing 14 which houses therein a valve (not shown) for controlling the action of the air cylinder, a grip 16, and side plates 18*a* and 18*b* which are attached to the cylinder housing 12.

Further, a magazine 20 is attached to the front end portion of the side plate 18*a*.

Figure 3:
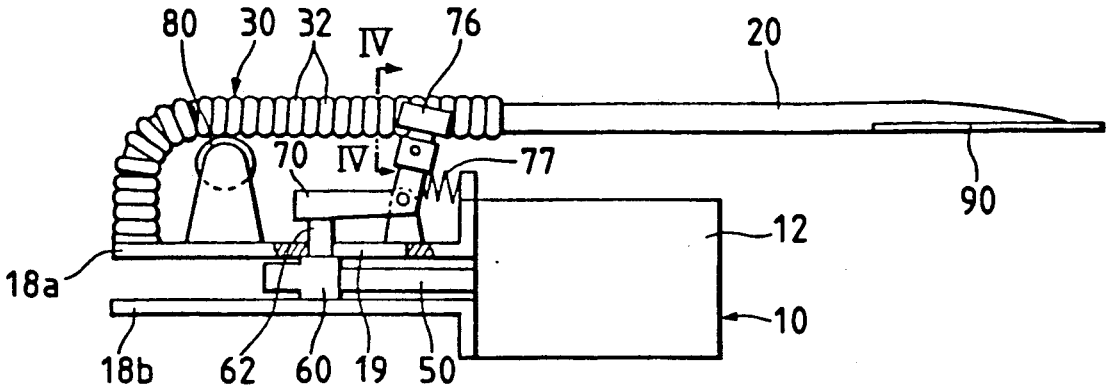
FIG. 3 is a plan view showing part of the C ring clamping device illustrated in FIG. 2.
Figure 4:
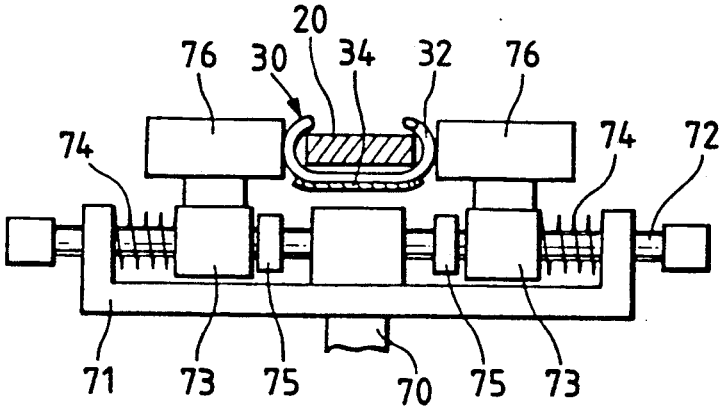
FIG. 4 is a sectional view taken along line IV—IV in FIG. 3.

As shown in FIGS. 3 and 4, a large number of C rings 32 are arranged in a row, and an adhesive tape 34 is bonded to the backs of the C rings 32 to form a C ring assembly 30 comprising the C rings 32. The C ring assembly 30 is loaded onto the magazine 20.

Jaws 40 are mounted pivotably to the side plates 18*a* and 18*b* are driven by the air cylinder accommodated in the cylinder housing 12.

A piston rod 50 of the air cylinder in the cylinder housing 12 is positioned between the side plates 18*a* and 18*b*. A compressed air hose mounting portion 52 is attached to the bottom of the grip 16 and it is in communication with a valve inlet. A trigger 54 for operating the valve is mounted to the side plates 18*a* and 18*b*.

A front-end member 60 is mounted to the front end portion of the piston rod 50. A knock pin 62 is mounted to the front-end member 60 and extends through a slit 19 formed in the side plate 18*a*.

A pivotable member 70 is mounted pivotably to the side plate 18*a* and it can come into contact with the knock pin 62. The contact surface of the pivotable member 70 with the knock pin 62 is inclined downwards toward the left-hand side in FIG. 3. As shown in detail in FIG. 4, a support base 71 is mounted to the pivotable member 70, and a rod 72 is mounted on the support base 71. A movable member 73 is mounted movably on a rod 72. A columnar feed member 76 is mounted to the movable member 73. The feed member 76, which is formed of rubber for example, is provided in a position for contact with the C ring assembly 30 loaded onto the magazine 20. A spring 74 is provided between the support base 71 and the movable member 73. The feed member 76 is pushed against the C ring assembly 30 by means of the spring 74. A stopper 75 is mounted on the rod 72 to restrict the movement of the movable member 73. A spring 77 is provided between the C ring clamping device body 10 and the pivotable member 70, the pivotable member 70 is pushed against the knock pin 62 by means of the spring 77.

A presser wheel 80 is mounted to the side plate 18a through a one-way bearing (not shown) in a position for contact with the C ring assembly 30 loaded on the magazine 20. The said one-way bearing rotates only counterclockwise in FIG. 3.

One end of a spring steel 90 is attached to an end portion of the magazine 20. The width of the spring steel 90 is smaller than the inside width of each C ring 32 and larger than the opening width of the same ring.

Figure 5:
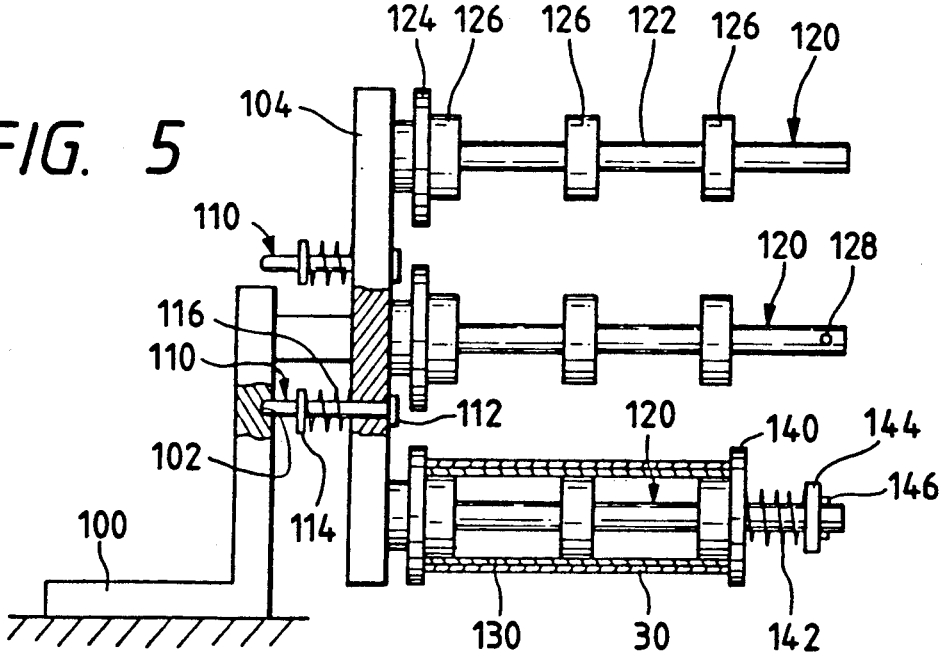
FIG. 5 is an enlarged view as seen in the direction of arrow V in FIG. 1.

As shown in FIG. 5, a hole 102 is formed in a support base 100, and a rotatable plate 104 is mounted rotatably to the support base 100.

A positioning pin 112 is mounted to the rotatable plate 104 movably right- and leftwards in FIG. 5. The positioning pin 112 is provided in a position in which the front end thereof is engaged with the hole 102. A ring 114 is mounted on the pin 112, and a spring 116 is provided between the ring 114 and the rotatable plate 104 to push the positioning pin 112 leftwards in FIG. 5. The positioning pin 112, the ring 114 and the spring 116 constitute a positioning mechanisms 110. There are provided four positioning mechanisms 110.

A rod 122 is mounted to the rotatable plate 104, and a positioning plate 124 is mounted rotatably on the rod 122. Also, support members 126 are mounted rotatably on the rod 122. A pin hole 128 is formed in the front end portion of the rod 122. The rod 122, the positioning plate 124 and the support members 126 constitute a mounting mechanism 120. Four mounting mechanisms 120 are provided in correspondence to the positioning mechanisms 110.

The C ring assembly 30 is wound round a paper tube 130.

A positioning plate 140 is mounted removably on the rod 122, and a spring holding member 144 is also mounted on the rod 122 removably. Further, a spring is provided between the positioning plate 140 and the spring holding member 144, and a pin 146 is inserted into the pin hole 128.

Figure 6:
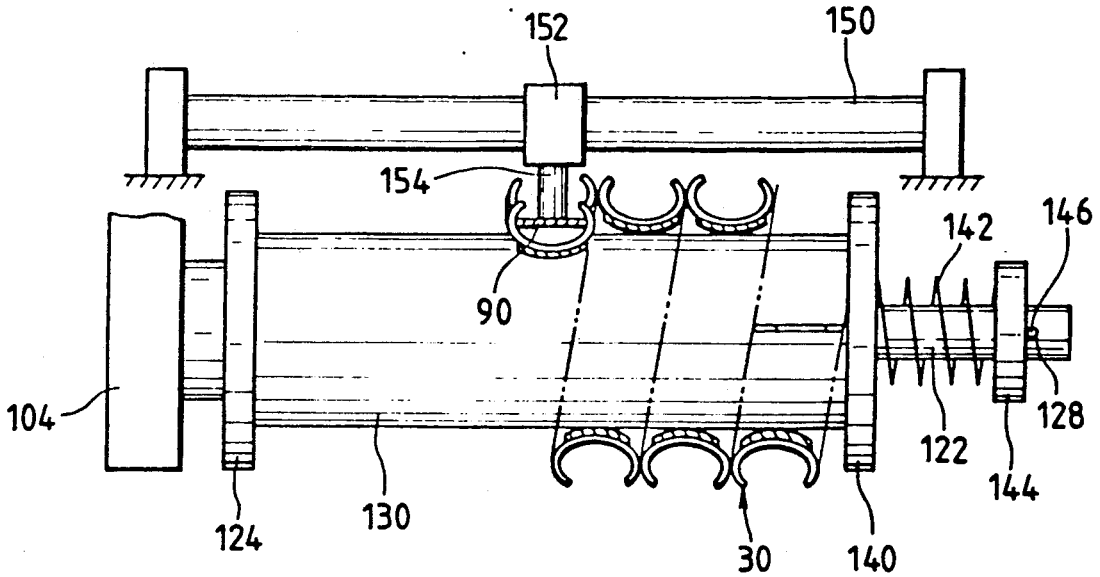
FIG. 6 is an enlarged sectional view taken along line VI—VI in FIG. 1.

As shown in FIG. 6, a guide rod 150 is provided in parallel with the rod 122, and a movable member 152 is mounted movably on a guide rod 150. A mounting piece 154 is attached to the movable member 152, and the other end of the spring steel 90 is attached to the mounting piece 154.

Figure 7:
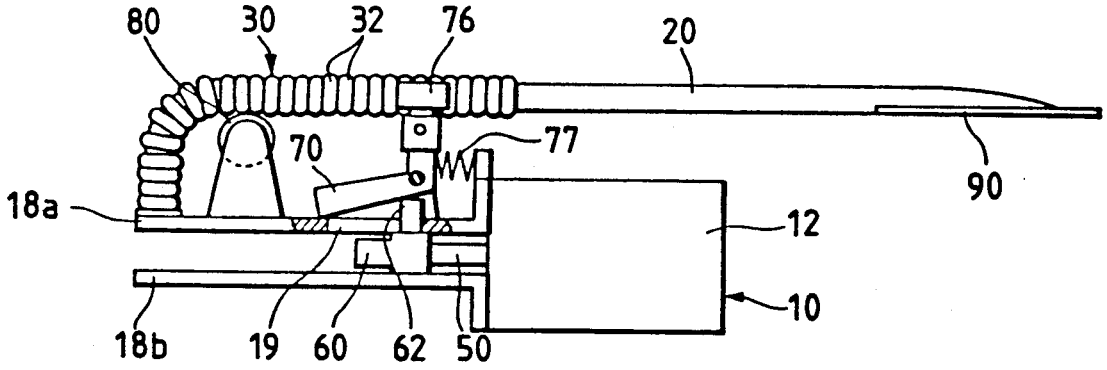
FIG. 7 is a view explanatory of the operation of the C ring clamping device illustrated in FIG. 3, etc.

In the C ring clamping device and C ring feeding device described above, first the paper tube 130 with the C ring assembly 30 wound thereon is mounted to the mounting mechanism 120, then the positioning plate 140 and the spring holding member 144 are mounted on the rod 122 while the spring 142 is disposed therebetween, and the pin 146 is inserted into the pin hole 128. Thereafter, as shown in FIG. 6, the C ring assembly 30 is brought into engagement with the spring steel 90 and the front end of the C ring assembly 30 is positioned at the base portion of the magazine 20. In this state, the trigger 54 is pulled to perform the clamping operation, so that the feed member 76 pushes the C ring assembly 30 forward, whereby the C ring assembly 30 can be fed. More specifically, when the trigger 54 is pulled to operate the air cylinder for the clamping operation, the front-end member 60 and the knock 62 move right- and leftwards in FIG. 3. In the state shown in FIG. 3, when the knock pin 62 moves rightwards in FIG. 7, the pivotable member 70 pivots counterclockwise in FIG. 7 and the C ring assembly 30 is fed leftwards in the same figure by the feed member 76. On the other hand, in the state illustrated in FIG. 7, when the knock pin 62 moves leftwards in FIG. 3, the pivotable member 70 pivots clockwise in FIG. 3. In this case, a backward movement of the C ring assembly 30 is prevented by the presser wheel 80. Therefore, the C ring assembly 30 can be fed by pushing the forefront portion thereof. Consequently, the length of the C ring assembly 30 can be made very large and hence the C ring assembly loading operation can be greatly simplified, whereby the efficiency of the clamping operation using the C rings 32 can be improved to a great extent. With successive feed of the C rings 32 at the front end portion of the C ring assembly 30 to the clamping portion, the paper tube 130 rotates and the movable member 152 moves, whereby the C ring assembly 30 is fed from the paper tube 130 to the spring steel 90. Since the positioning plate 140 is pushed against the paper tube 130 by the spring 142, the rotation of the paper tube due to inertia is prevented, whereby the C ring assembly 30 can be prevented from becoming loose near the paper tube 130. When the C ring assembly wound round the paper tube 130 is used up during the clamping operation, the positioning pin 112 is moved rightwards in FIG. 5 against the spring 116 until the front end thereof is disengaged from the hole 102. Thereafter, the rotatable plate 104 is rotated to bring the front end of the next positioning pin 112 into engagement with the hole 102. In this state, an end portion of the C ring assembly 30 engaged with the spring steel 90 and an end portion of the C ring assembly 30 wound round the paper tube 130 are connected together with an adhesive tape.

Although the above description concerns the C ring clamping device, it goes without saying that the present invention is also applicable to other hog ring clamping devices. Although in the above embodiment there are used two feed members 76, there may be used only one feed member.

What is claimed is:

1. A C ring clamping device comprising:

a) a C ring clamping device body;

b) jaws provided on said clamping device body for holding a C ring being clamped;

c) a driving means, having a first movable member, for pivotally moving said jaws;

d) a C ring magazine mounted to said clamping device body for engaging a plurality of individual successively aligned C rings to be clamped;

e) a pivotable member pivotably mounted to said clamping device body and capable of abuttingly engaging with a knock pin mounted to said first movable member;

f) the knock pin mounted to said first movable member for causing said pivotable member to pivotally move in response to movement of said first movable member;

g) a first spring connected between said pivotable member and said clamping device body for urging said pivotable member against the knock pin;

h) first and second feed members for feeding successive ones of said plurality of C rings in response to pivotal movement of said pivotable member, said first and second feed members being provided on opposing sides of said magazine and mounted to said pivotable member in a position for contact with opposing sides of a first one of the plurality of C rings engaged by said magazine; and i) a presser wheel, mounted to said clamping device body through a unidirectional rotating means and in a position for contact with a second one of the plurality of C-rings engaged with the magazine, for preventing said plurality of C rings from moving in a direction opposite to said pre-defined direction while individual ones of said plurality of C rings engaged in the magazine are being fed to said jaws.

2. The C ring clamping device according to claim 1 further comprising:

a) a support base mounted to said pivotable member, said support base having two opposing legs and a rod extending through both of said legs;

b) second and third movable members movably mounted on said rod and to which are respectively mounted said first and second feed members; and c) a second spring provided between each of said legs of said support base and a corresponding one of said movable members for urging said first and second feed members against the first one of said plurality of C rings.

3. The C ring clamping device according to claim 2 further comprising a stopper mounted on said rod for restricting the movement of said second and third movable members along said rod and towards the first one of said plurality of C rings.

* * * * *